US005145157A

United States Patent [19]

Polk

[11] Patent Number: 5,145,157

[45] Date of Patent: Sep. 8, 1992

[54] ADJUSTABLE WORKPIECE-HOLDING SYSTEM

[76] Inventor: James D. Polk, 720 Monroe St., Hoboken, N.J. 07030

[21] Appl. No.: 675,085

[22] Filed: Mar. 25, 1991

[51] Int. Cl.[5] ..... B25B 1/24

[52] U.S. Cl. ..... 269/266; 269/210

[58] Field of Search ..... 269/210, 212, 265, 266, 269/267, 284

[56] References Cited

U.S. PATENT DOCUMENTS

| | | | |
|---|---|---|---|
| 1,256,217 | 2/1918 | Fieldhouse . | |
| 1,289,205 | 12/1918 | Lane . | |
| 1,715,659 | 6/1929 | Joksch . | |
| 3,024,018 | 3/1962 | Manz | 269/265 |
| 3,103,353 | 4/1963 | Lassy | 269/267 |
| 3,434,400 | 3/1969 | Hochfeld | 93/84 |
| 3,592,461 | 7/1971 | Lauriti | 269/267 |
| 3,868,102 | 2/1975 | Pevar | 269/26 |
| 4,047,709 | 9/1977 | Thyberg et al. | 269/266 |
| 4,706,973 | 11/1987 | Covarrubias et al. | 269/266 |
| 4,732,373 | 3/1988 | Yang | 269/241 |

FOREIGN PATENT DOCUMENTS

| | | | |
|---|---|---|---|
| 315925 | 3/1918 | German Democratic Rep. | 269/266 |
| 767334 | 1/1957 | United Kingdom | 269/266 |

*Primary Examiner*—J. J. Swann

*Attorney, Agent, or Firm*—Leighton K. Chong

[57] ABSTRACT

An adjustable workpiece holder has at least one jaw member holding a plurality of finger elements lengthwise in parallel therein. The finger elements have side surfaces with serrations formed over a given length thereof. The serrations allow the finger elements to be selectively adjustable in lengthwise position relative to adjacent finger elements, so that they can conform to the contour of the workpiece. The finger elements may have a total width that fits snugly within a recess or pocket of the jaw member. A releasable clamp applies firm lateral pressure to the finger elements to prevent any slippage. The jaw member may be part of a machining assembly or retrofitted to one or both sides of a standard milling or drill press vise. It may also be adapted for use in forming, stamping, bending, or shaping material, or for profiling or as a template for holding or positioning workpieces in other applications.

14 Claims, 2 Drawing Sheets

ADJUSTABLE WORKPIECE-HOLDING SYSTEM

FIELD OF THE INVENTION

This invention generally relates to an adjustable workpiece-holding system, and particularly to one having a jaw which can be adjusted to conform to the contour of a workpiece.

BACKGROUND ART

In the field of machine tools, it is desireable to have workpiece-holding tools which can be adjusted to conform to the contour of a workpiece. In many types of applications, a workpiece may have an undulating or curved surface. If the jaws of the workpiece-holder present a hard, linear surface, then uneven or unstable pressure may be applied on the workpiece, which could result in deformation or slippage of the workpiece.

Prior approaches to providing an adjustable workpiece holder have certain disadvantages in operation or convenience. In U.S. Pat. No. 1,256,217 to Fieldhouse, U.S. Pat. No. 3,103,353 to Lassy, or U.S. Pat. No. 3,592,461 to Lauriti, an adjustable vise jaw has a plurality of individual plate or block sections in parallel which conform to small variations in the contour of a workpiece by adjustments obtained through one or more rows of loosely-packed rollers or bearings abutting the rear ends of the block sections. However, in such systems, the range of adjustment is severely limited, and the block sections are not securely held in their positions and may slip or assume a different shape upon placement of each workpiece.

In U.S. Pat. No. 1,715,659 to Joksch and U.S. Pat. No. 3,868,102 to Pevar, individual block sections of the jaw are provided with a greater range of adjustment and are more securely held in position by means of a mechanism for applying hydraulic or plastic pressure to the block sections. However, such mechanisms are relatively costly and complex in structure and operation and are not readily retrofitted to existing machine tools.

It is therefore a principal object of the invention to provide an adjustable workpiece-holding system having a plurality of block sections or fingers in parallel, wherein the fingers can be adjusted over a wide range of adjustment yet are held securely in their positions. It is a further object that such a system be inexpensive and simple in structure and operation and can be readily retrofitted to existing machine tools.

SUMMARY OF THE INVENTION

In accordance with the present invention, an adjustable workpiece-holding system comprises at least one jaw member for applying pressure against a workpiece, said jaw member holding a plurality of finger elements lengthwise in parallel therein, said finger elements having front ends thereof facing toward the workpiece and side surfaces thereof abutting in contact with those of respective, adjacent finger elements, wherein the side surfaces of the finger elements have serrations formed thereon over a given length of said finger elements, said serrations being substantially uniform and symmetric with each other such that each finger element is selectively adjustable in lengthwise position relative to adjacent finger elements and is securely held in its lengthwise position by positive engagement of the serrations of its side surfaces with those of the adjacent finger elements.

In a preferred embodiment, the finger elements have a total width, including engaged serrated side surfaces, that fits closely within the width of a rectangular-shaped recess in the jaw member. In another variation, a releasable clamp member is used to apply firm lateral pressure to the finger elements to prevent any slippage between their engaged serrations. The jaw member of the present invention can be retrofitted to one or both sides of a standard milling or drill press vise.

Other objects, features and advantages of the present invention will be apparent from the following detailed description of the preferred embodiments with reference to the drawings, of which:

DETAILED DESCRIPTION OF THE INVENTION

The present invention facilitates the holding or clamping of an object of curved or non-linear contour. The invention basically encompasses a holder containing parallel finger elements, the adjacent sides of which are serrated to permit the finger elements to be positioned at different lengthwise positions in relation to each other. The dimensions of the finger elements and serrations are chosen to allow conformance to a range of contours and in many different applications.

Figure 1:
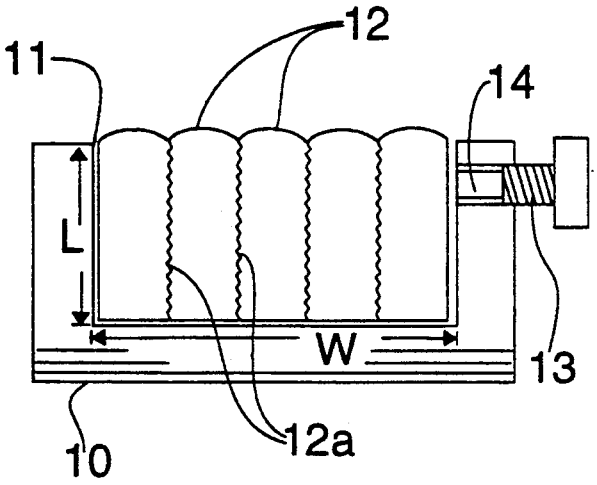
FIG. 1 is a schematic side view of an adjustable workpiece-holding system in accordance with the invention having a jaw member with a plurality of finger elements with serrated side surfaces therein.
Figure 2:
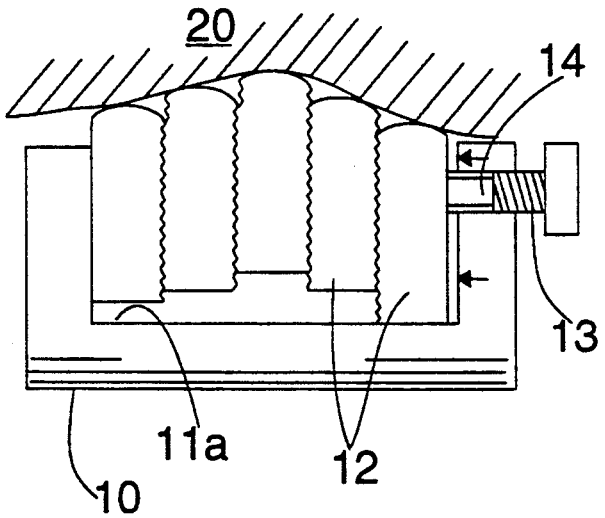
FIG. 2 is a schematic side view of the jaw member of FIG. 1 showing the application of lateral pressure to secure the finger elements in respective positions for a contour adjustment.

Referring to FIGS. 1 and 2, an adjustable workpiece-holding system in accordance with the present invention has at least one jaw member 10 for applying pressure against a workpiece. The workpiece is depicted in FIG. 2 as having a curved contour 20. The jaw member has a rectangular jaw recess 11 having a predetermined width W in a direction tranverse to, and length L in a direction toward, the workpiece. A plurality of finger elements 12 have equal lengths and are arranged lengthwise in parallel in the recess 11. Each finger has a front end facing toward the workpiece and side surfaces 11*a* abutting in contact with those of respective, adjacent finger elements.

The side surfaces 11*a* of the finger elements have arrays of serrations formed thereon over a given length of the finger elements. The serrations are substantially uniform, with a given pitch and depth, and are symmetric with each other such that any of the serrations can engage any of the others along the length of the finger elements. By engaging the serrated side surfaces, the finger elements can be selectively adjusted in lengthwise position relative to adjacent finger elements, so as to have the front ends of the finger elements conform to the workpiece 20. The finger elements are securely held in their positions by positive interlocking of the serrations of its side surfaces with those of the adjacent finger elements. In FIG. 1, the finger elements 12 are shown in alignment with each other for holding a linear workpiece surface, whereas in FIG. 2, they are adjusted in their lengthwise positions to conform to the curved workpiece surface 20.

The jaw member 10 may be made of forged or cast material. The finger elements 12 may be machined from steel blanks with the serrations sawed or milled in the side surfaces. The finger elements may also be molded with high density plastic, such as Delrin TM plastic, or even ceramic materials. The front ends of the finger elements may be rounded or made of a softer material in a composite construction, in order to minimize the risk of scratching or deforming the surface of the workpiece.

The finger elements may have a total width, including engaged serrated side surfaces, that fits snugly within the width W of the recess 11*a*. In such a configuration, the finger elements are lifted from the recess 11*a*, adjusted to the desired contour, then pressed back into position in the jaw member. Alternatively, the jaw member may have a releasable clamp or threaded screw 13 for pressing a block or spacer 14 in the lateral direction into pressure contact with the finger elements 12 and against one side wall of the recess 11*a*. The threaded screw 13 is loosened to allow the lengthwise positions of the finger elements to be adjusted, and then tightened in order to apply firm lateral pressure to hold the setting. At least one finger element can always be abutted with a bottom wall of the recess 11*a* for any given contour, so that any clamping force is transferred through the fingers to the bottom wall of the jaw member. The two outer finger elements and the side walls of the recess 11*a* are shown in the figures as having smooth surfaces. Alternatively, they may also have serrations for increasing the positive holding of the finger elements 12 in the jaw member 11.

Figure 3:
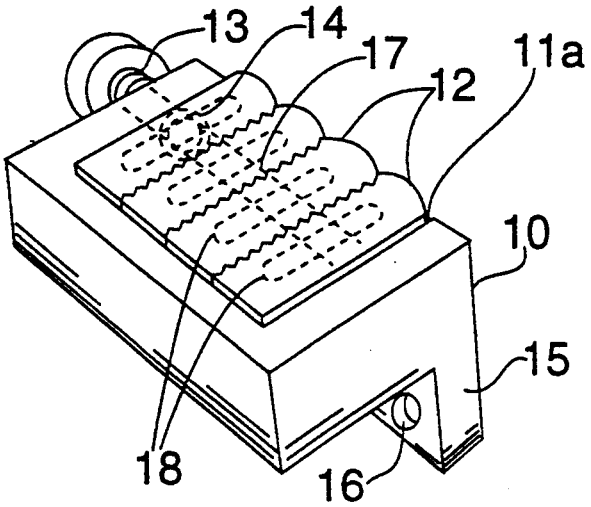
FIG. 3 illustrates another version of the jaw member adapted for retrofitting to a standard milling or drill press vise.

In FIG. 3, a variation of the jaw member 10 has a flange portion 15 with mounting holes 16 so that it can be retrofitted to one or both sides of a standard milling or drill press vise. Thus, the hardened steel blocks on a standard vise can be removed, and the jaw member of the invention having the adjustable finger elements can be substituted in their place. The threaded screw 13 or spacer 14 may also have an extension 17 which extends through elongated slots 18 in the finger elements to the opposite side walls in order to keep the finger elements from accidentally falling out of jaw recess 11*a*.

Figure 4:
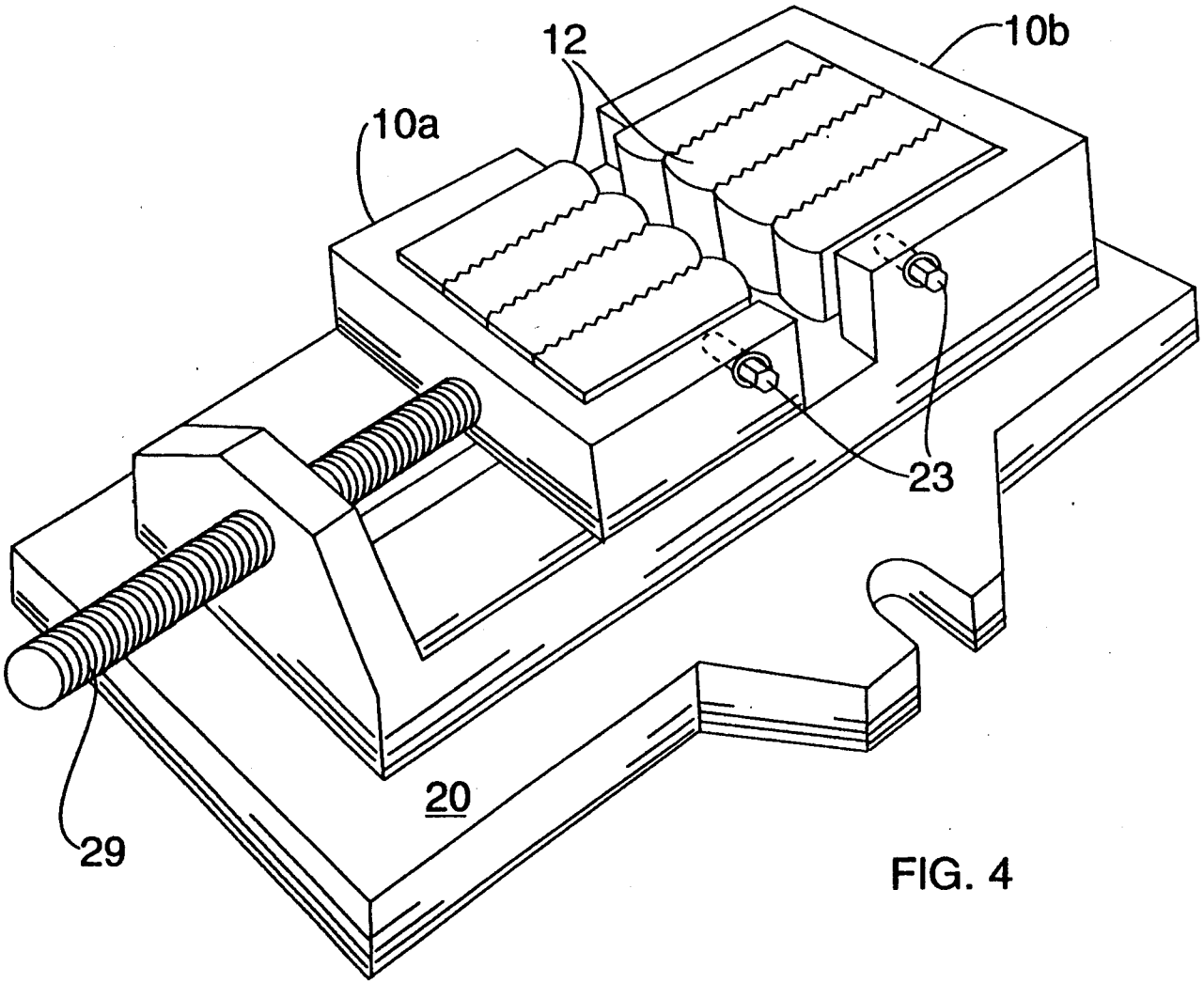
FIG. 4 illustrates another embodiment having two opposed jaw members with adjustable finger elements.

In FIG. 4, another version of the present invention has complementary sets of parallel finger elements 12 incorporated into the moving and stationary jaws 10*a* and 10*b*, respectively, of a milling vise. The movable jaw member 10*a* is moved through operation of a threaded rod 29 to clamp a workpiece against the other jaw member 10*b* which is fixed to a stationary base 20. Threaded hex screws 23 may be used to tightened the fingers in their respective settings. This configuration allows both sides of the clamp or vise to be conformed to the workpiece surface. The assembly can be incorporated into any type of standard vise, from the smallest to the largest production milling vises.

For normal machining applications, five to ten finger elements of about 0.5 inch width, 3.0 inch length, and 1.25 inch depth each, having sawtooth serrations of about 0.066 (1/16) inch pitch, are suitable for the type of contour variations and holding pressures likely to be encountered. The system of the invention may also find useful application in other fields. For example, the finger elements may be used for forming, bending, stamping, or shaping material. The finger elements can impress a desired contour in the material for hot or cold forming of steel and other metals, such as sheet metal, or thermoplastic material, such as acyrlic.

The system may also be used for profiling, or as an adjustable template device for an assembly line, so that parts may be properly positioned at different points of a workpiece area. The adjustable finger elements may also be used in robotic arm assemblies to allow them to be readily adjusted for different gripping or holding arrangements. For applications involving holding, profiling, or positioning objects, finger elements of narrower width and shallower depth may be used to allow a higher resolution contour to be followed. For example, the finger elements may be made of Delrin TM strips having a width of 0.125 (⅛) inch with the serrations molded into the surfaces of the strips, or thin metal strips having the serrations etched therein.

Although the invention has been described with reference to certain preferred embodiments, it will be appreciated that many variations and modifications may be made consistent with the broad principles of the invention. It is intended that the preferred embodiments and all of such variations and modifications be included within the scope and spirit of the invention, as defined in the following claims.

I claim:

1. An adjustable workpiece-holding system comprising:

at least one jaw member for applying pressure against a workpiece, said jaw member holding a plurality of finger elements extending lengthwise in parallel in a longitudinal direction of said jaw member, said finger elements having front ends thereof facing toward the workpiece and side surfaces thereof abutting in contact with those of respective, adjacent finger elements, wherein the side surfaces of the finger elements have serrations extending in parallel in a direction transverse to the longitudinal direction and being formed over a given length in the longitudinal direction of the side surfaces of said finger elements, said serrations being substantially uniform and symmetric with each other such that each finger element is selectively adjustable in lengthwise position relative to adjacent finger elements and is securely held in its lengthwise position by positive engagement of the serrations of its side surfaces with those of the adjacent finger elements to create an exact predetermined contour shape for retention of a workpiece, and wherein said serrations provide fast and easy reproduction of said exact contour shape.

2. An adjustable workpiece-holding system according to claim 1, wherein said finger elements have a total width, including engaged serrated side surfaces, that fits snugly within a rectangular-shaped recess in said jaw member.

3. An adjustable workpiece-holding system according to claim 1, further comprising a releasable clamp member for applying lateral pressure to the finger elements to prevent slippage between their engaged serrations.

4. An adjustable workpiece-holding system according to claim 1, wherein said jaw member includes a mounting portion for allowing it to be retrofitted to a standard milling or drill press vise.

5. An adjustable workpiece-holding system according to claim 1, further comprising a second one of said jaw member with said adjustable finger elements disposed opposing the first said jaw member.

6. An adjustable contour-following system comprising:

at least one holder member adapted to be placed in contact with a given contour of a workpiece, said holder member holding a plurality of finger elements extending lengthwise in parallel in a longitudinal direction of said holder member, said finger elements having front ends thereof facing toward the workpiece and side surfaces thereof abutting in contact with those of respective, adjacent finger elements, wherein the side surfaces of the finger elements have serrations extending in parallel in a direction transverse to the longitudinal direction and being formed over a given length in the longitudinal direction of the side surfaces of said finger elements, said serrations being substantially uniform and symmetric with each other such that each finger element is selectively adjustable in lengthwise position relative to adjacent finger elements and is securely held in its lengthwise position by positive engagement of the serrations of its side surfaces with those of the adjacent finger elements to create an exact predetermined contour shape for retention of a workpiece, and wherein said serrations provide fast and easy reproduction of said exact contour shape.

7. An adjustable contour-following system according to claim 6, wherein said finger elements have a total width, including engaged serrated side surfaces, that fits snugly within a rectangular-shaped recess in said holder member.

8. An adjustable contour-following system according to claim 6, further comprising a releasable clamp member for applying lateral pressure to the finger elements to prevent slippage between their engaged serrations.

9. An adjustable workpiece-holding system according to claim 6, further comprising a second one of said jaw member with said adjustable finger elements disposed opposing the first said jaw member.

10. An adjustable contour-following system according to claim 6, further comprising a second one of said holder member with said adjustable finger elements disposed opposing the first said holder member.

11. An adjustable contour-following system according to claim 6, wherein said finger elements are made of metal and have a width of about 0.5 inch and length of about 3.0 inch, and are about five to ten in number.

12. An adjustable contour-following system according to claim 6, wherein said finger elements are made of Delrin TM strips having a width of 0.125 ($\frac{1}{8}$) inch with the serrations molded into the surfaces of the strips.

13. An adjustable contour-following system according to claim 6, wherein said finger elements are made of thin metal strips having the serrations etched therein.

14. An adjustable contour-following system according to claim 6, wherein said holder member includes a mounting portion for allowing it to be retrofitted to a standard machine.

* * * * *